US008960309B2

(12) United States Patent
Davis

(10) Patent No.: US 8,960,309 B2
(45) **Date of Patent: *Feb. 24, 2015**

(54) OIL WELL PUMP APPARATUS

(76) Inventor: Raymond C. Davis, Lake Charles, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/556,574

(22) Filed: Jul. 24, 2012

(65) Prior Publication Data

US 2013/0020070 A1 Jan. 24, 2013

Related U.S. Application Data

(63) Continuation of application No. 11/865,494, filed on Oct. 1, 2007, now Pat. No. 8,225,873, which is a continuation-in-part of application No. 10/372,533, filed on Feb. 21, 2003, now Pat. No. 7,275,592.

(51) Int. Cl.

| | |
|---|---|
| ***E21B 43/00*** | (2006.01) |
| ***F04C 2/10*** | (2006.01) |
| ***E21B 43/12*** | (2006.01) |
| ***F01C 13/04*** | (2006.01) |
| ***F04C 11/00*** | (2006.01) |
| ***F04C 13/00*** | (2006.01) |
| *F04C 2/12* | (2006.01) |

(52) U.S. Cl.

CPC ..... *F04C 2/102* (2013.01); *E21B 43/129* (2013.01); *F01C 13/04* (2013.01); *F04C 11/003* (2013.01); *F04C 13/008* (2013.01); *F04C 2/12* (2013.01); *F04C 2210/10* (2013.01); *F04C 2210/12* (2013.01); *F04C 2210/24* (2013.01); *F04C 2240/30* (2013.01); *F04C 2240/806* (2013.01)

USPC ..... 166/369; 166/68

(58) Field of Classification Search

USPC ..... 166/369, 371, 265, 263.5, 68; 417/405, 417/406, 904; 418/166, 171

See application file for complete search history.

(56) References Cited

U.S. PATENT DOCUMENTS

| | | | |
|---|---|---|---|
| 631,691 | A | 8/1899 | Blot |
| 1,702,838 | A | 2/1929 | Oliphant |
| 2,263,144 | A | 11/1941 | Scott |
| 2,658,457 | A | 11/1953 | Harbison |
| 2,676,547 | A | 4/1954 | Knox |
| 2,737,119 | A | 3/1956 | Hill |
| 2,910,948 | A | 11/1959 | Betzen |
| 3,054,415 | A | 9/1962 | Baker et al. |
| 3,171,630 | A | 3/1965 | Harney et al. |
| 3,273,501 | A | 9/1966 | Tothero |

(Continued)

*Primary Examiner* — Kenneth L Thompson
*Assistant Examiner* — Kipp Wallace
(74) *Attorney, Agent, or Firm* — Garvey, Smith, Nehrbass & North, L.L.C.; Charles C. Garvey, Jr.; Vanessa M. D'Souza

(57) ABSTRACT

An oil well pumping apparatus for pumping oil from a well to a wellhead provides a tool body sized and shaped to be lowered into the production tubing string. A working fluid is provided that can be pumped into the production tubing, by a prime mover. A flow channel into the well bore enables the working fluid to be circulated from the prime mover via the production tubing to the tool body at a location in the well and then back to the wellhead area. A pumping mechanism is provided on the tool body, including upper and lower spur gear or gears connected with a common shaft. The upper spur gear is driven by the working fluid. The lower spur gear is rotated by the first spur gear. The tool body has flow conveying portions that mix the working fluid and the produced oil as the oil is pumped.

35 Claims, 13 Drawing Sheets

(56) References Cited

U.S. PATENT DOCUMENTS

| | | | |
|---|---|---|---|
| 3,420,183 | A | 1/1969 | Hart |
| 3,506,068 | A | 4/1970 | Brown et al. |
| 3,741,298 | A | 6/1973 | Canton |
| 3,861,471 | A | 1/1975 | Douglas |
| 3,968,839 | A | 7/1976 | Swihart, Sr. |
| 4,007,784 | A | 2/1977 | Watson et al. |
| 4,086,030 | A | 4/1978 | David |
| 4,193,746 | A | 3/1980 | Aman, Jr. |
| 4,227,573 | A | 10/1980 | Pearce et al. |
| 4,239,458 | A | 12/1980 | Yeatts |
| 4,296,810 | A | 10/1981 | Price |
| 4,531,593 | A | 7/1985 | Elliott et al. |
| 4,540,347 | A | 9/1985 | Child |
| 4,624,312 | A | 11/1986 | McMullin |
| 4,820,135 | A | 4/1989 | Simmons |
| 4,828,036 | A | 5/1989 | Simmons |
| 4,889,473 | A | 12/1989 | Krueger |
| 4,986,739 | A | 1/1991 | Child |
| 5,127,803 | A | 7/1992 | Walter |
| 5,462,115 | A | 10/1995 | Belden et al. |
| 5,562,433 | A | 10/1996 | Cholet et al. |
| 5,611,397 | A | 3/1997 | Wood |
| 5,813,457 | A | 9/1998 | Giroux |
| 5,845,709 | A | 12/1998 | Mack et al. |
| 5,868,554 | A | 2/1999 | Giacomino et al. |
| 6,070,661 | A | 6/2000 | Kennedy et al. |
| 6,082,451 | A | 7/2000 | Giroux et al. |
| 6,082,452 | A | 7/2000 | Shaw et al. |
| 6,113,355 | A | 9/2000 | Hult et al. |
| 6,113,360 | A | 9/2000 | Yu et al. |
| 6,123,149 | A | 9/2000 | McKinzie et al. |
| 6,135,203 | A | 10/2000 | McAnally |
| 6,138,758 | A | 10/2000 | Shaw |
| 6,148,923 | A | 11/2000 | Casey |
| 6,167,965 | B1 | 1/2001 | Bearden et al. |
| 6,170,573 | B1 | 1/2001 | Brunet et al. |
| 6,209,637 | B1 | 4/2001 | Wells |
| 6,234,770 | B1 | 5/2001 | Ridley et al. |
| 6,328,111 | B1 | 12/2001 | Bearden et al. |
| 6,361,272 | B1 | 3/2002 | Bassett |
| 6,412,563 | B1 | 7/2002 | St. Clair et al. |
| 6,454,010 | B1 | 9/2002 | Thomas et al. |
| 6,615,926 | B2 | 9/2003 | Hester et al. |
| 6,644,399 | B2 | 11/2003 | Abbott et al. |
| 6,698,521 | B2 | 3/2004 | Schrenkel et al. |
| 7,275,592 | B2 | 10/2007 | Davis |
| 8,225,873 | B2 | 7/2012 | Davis |
| 2002/0134554 | A1 | 9/2002 | Schrenkel et al. |
| 2003/0141051 | A1 | 7/2003 | Abbott et al. |
| 2004/0035571 | A1 | 2/2004 | Abbott et al. |
| 2004/0144545 | A1 | 7/2004 | Lauritzen et al. |
| 2004/0256109 | A1 | 12/2004 | Johnson |
| 2006/0153695 | A1 | 7/2006 | Davis |

FIG. IC.

OIL WELL PUMP APPARATUS

CROSS-REFERENCE TO RELATED APPLICATIONS

This is a continuation of U.S. patent application Ser. No. 11/865,494, filed 1 Oct. 2007 (issuing as U.S. Pat. No. 8,225,873 on 24 Jul. 2012), which is a continuation in part of U.S. patent application Ser. No. 10/372,533, filed 21 Feb. 2003 (issued as U.S. Pat. No. 7,275,592 on 2 Oct. 2007), each of which is incorporated herein by reference.

Priority of U.S. patent application Ser. No. 11/865,494, filed 1 Oct. 2007, and U.S. patent application Ser. No. 10/372,533, filed 21 Feb. 2003, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well pumps. More particularly, the present invention relates to a downhole oil well pump apparatus that uses a circulating working fluid to drive a specially configured pump that is operated by the working fluid and wherein the pump transmits oil from the well to the surface by commingling the pumped oil with the working fluid, oil and the working fluid being separated at the wellhead or earth's surface. Even more particularly, the present invention relates to an oil well pump that is operated in a downhole cased, production pipe environment that utilizes a pump having a single pump shaft that has gerotor devices at each end of the pump shaft, one of the gerotor devices being driven by the working fluid, the other gerotor device pumping the oil to be retrieved.

2. General Background of the Invention

In the pumping of oil from wells, various types of pumps are utilized, the most common of which is a surface mounted pump that reciprocates between lower and upper positions. Examples include the common oil well pumpjack, and the Ajusta® pump. Such pumps reciprocate sucker rods that are in the well and extend to the level of producing formation. One of the problems with pumps is the maintenance and repair that must be performed from time to time.

BRIEF SUMMARY OF THE INVENTION

The present invention provides an improved pumping system from pumping oil from a well that provides a downhole pump apparatus that is operated with a working fluid that operates a specially configured pumping arrangement that includes a common shaft. One end portion of the shaft is a gerotor that is driven by the working fluid. The other end portion of the shaft has a gerotor that pumps oil from the well. In this arrangement, both the oil being pumped and the working fluid commingle as they are transmitted to the surface. A separator is used at the earth's surface to separate the working fluid (for example, water) and the oil.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 1A, 1B, 1C are a sectional elevation view of the preferred embodiment of the apparatus of the present invention, wherein the drawing 1A matches to the drawing 1B at match lines A-A and the drawing 1B matches to the drawing 1C at match lines B-B;

DETAILED DESCRIPTION OF THE INVENTION

Figure 1A:
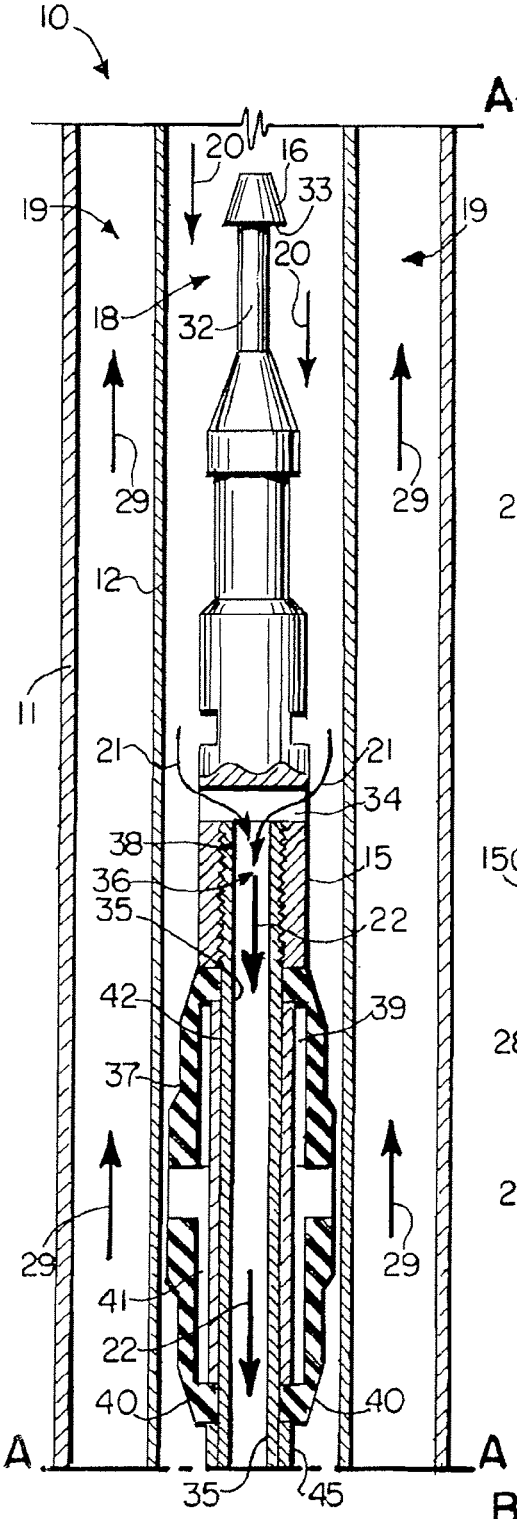
Figure 1B:
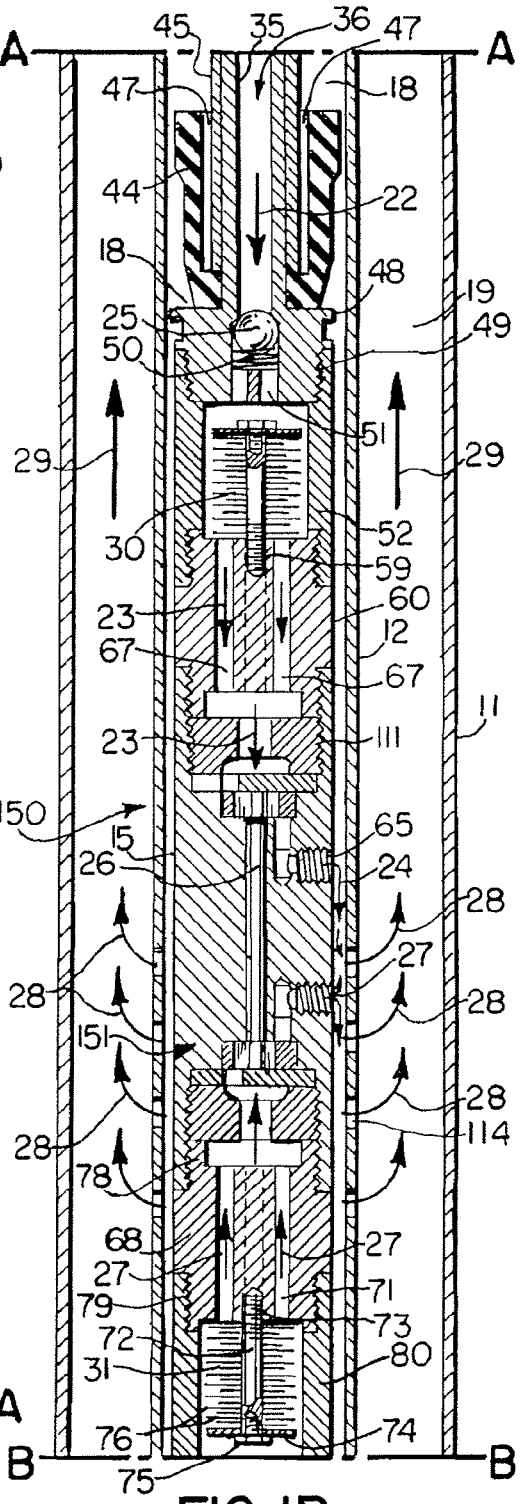

Oil well pump apparatus 10 as shown in the sectional elevation view of FIGS. 1A, 1B and 1C are in the lines A-A in FIGS. 1A and 1B are match lines and the lines B-B in FIGS. 1B and 1C are match lines. Oil well pump 10 is to be used in a well casing 11 that surrounds production tubing 12. A packer 13 is set in between casing 11 and production tubing 12 as shown in FIG. 1C. Landing nipple 14 is positioned above packer 13. The landing nipple 14 receives the lower end portion 17 of tool body 15 as shown in FIG. 1C. Tool body 15 can be pumped hydraulically (FIG. 11A) or lowered into the production tubing 12 bore 18 using a work string (not shown) that grips neck portion 32 at tool body 15 upper end 16.

Figure 11A:
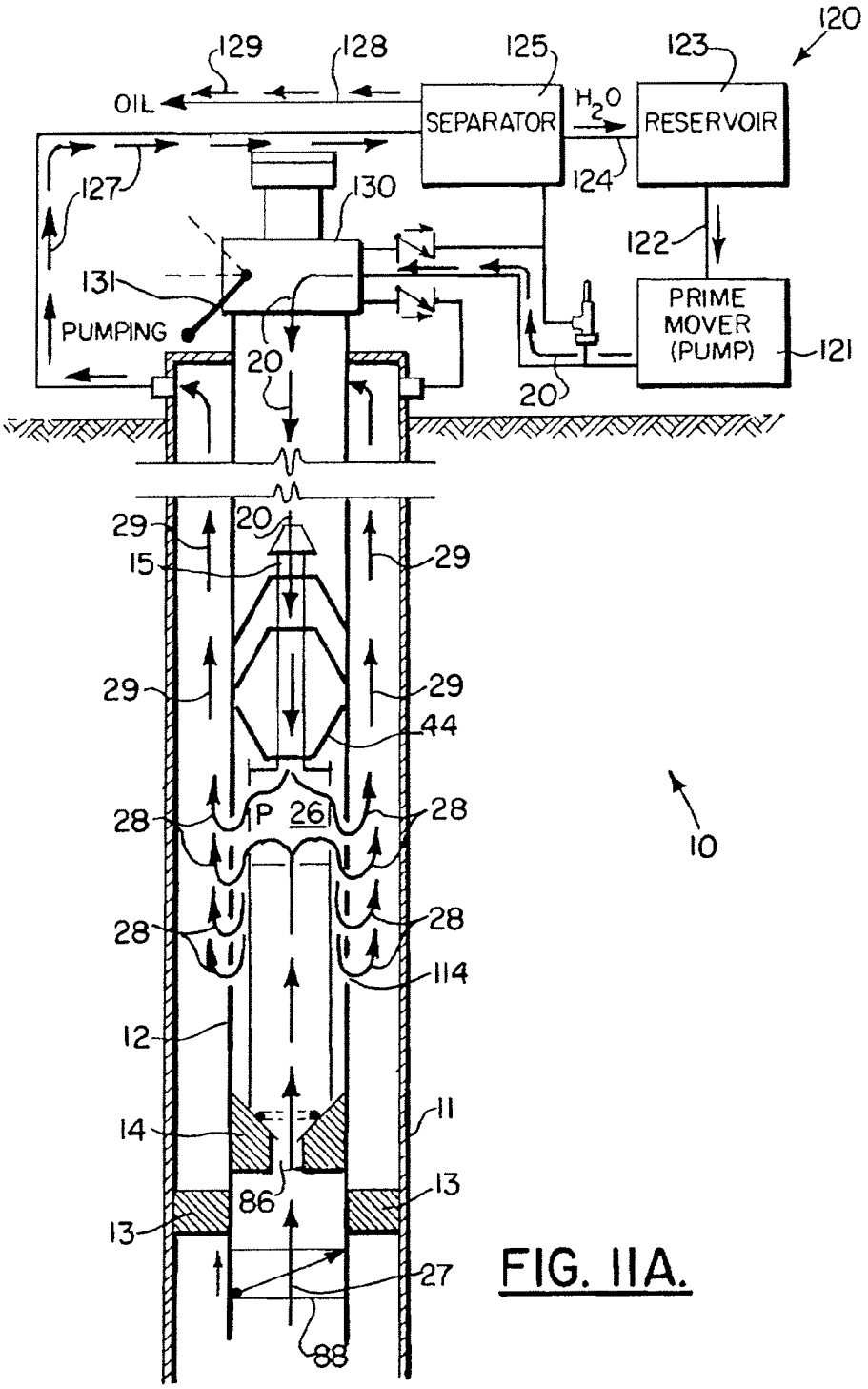
FIG. 11A is a schematic diagram showing operation of the apparatus and method of the present invention in a pumping position.

The apparatus 10 of the present invention provides an oil well pump 10 that has a tool body 15 that is elongated to fit inside of the bore 18 of production tubing 12 as shown in FIGS. 1A-1C. A well annulus 19 is that space in between casing 11 and production tubing 12. During use, a working fluid such as water, "lease" water, or an oil water mixture can be used to power pump mechanism 26. This working fluid follows the path that is generally designated by the arrows 20, 21, 22 and 23 in FIGS. 1A-1B. The working fluid is pumped from the wellhead area 120 using a prime mover 121 as shown in FIG. 11A and indicated by arrows 20.

Prime mover 121 can be a commercially available pump that receives working fluid via flowline 122 from reservoir 123. Reservoir 123 is supplied with the working fluid such as water via flowline 124 that exits oil/water separator 125.

As the working fluid is pumped by prime mover 121 in the direction of arrows 20 through production tubing 12, the working fluid enters tee-shaped passage 34 as indicated by arrows 21. The working fluid then travels in sleeve bore 36 of sleeve 35 as indicated by arrows 22 until it reaches connector 60 and its flow passages 67. Arrows 23 indicate the flow of the working fluid from the passages 67 to retainer 111 and its passageways 112, 113. At this point, the working fluid enters pump mechanism 26 (see FIGS. 1B, 2, and 3-6). A check valve 25 is provided that prevents oil from flowing in a reverse direction. This check valve 25 has a spring 50 that is overcome by the pressure of working fluid that flows through passageway 51 in the direction of arrows 20, 21, 22, 23. The working fluid exits tool body 15 via passageway 137 and working fluid discharge port 65 (see arrow 24).

The pump mechanism 26 is driven by the working fluid. The pump mechanism 26 also pumps oil from the well in the direction of oil flow arrows 27 as shown in FIGS. 1B, 1C and 11A. Connector 68 attaches to the lower end of pump mechanism housing 63. Connector 68 provides upper and lower external threads 69, 70 and flow passages 71 that enable oil to be produced to reach lower filter 31, suction ports 133, 134 of retainer 132 and lower gerotor device 151 so that the oil can be pumped by lower gerotor device 151 via passageway 135 to produced oil discharge port 66. At discharge port 66, the produced oil enters production tubing bore 18 where it commingles with the working fluid, the commingled mixture flowing into annulus 19 via perforations 114.

Figure 7B:
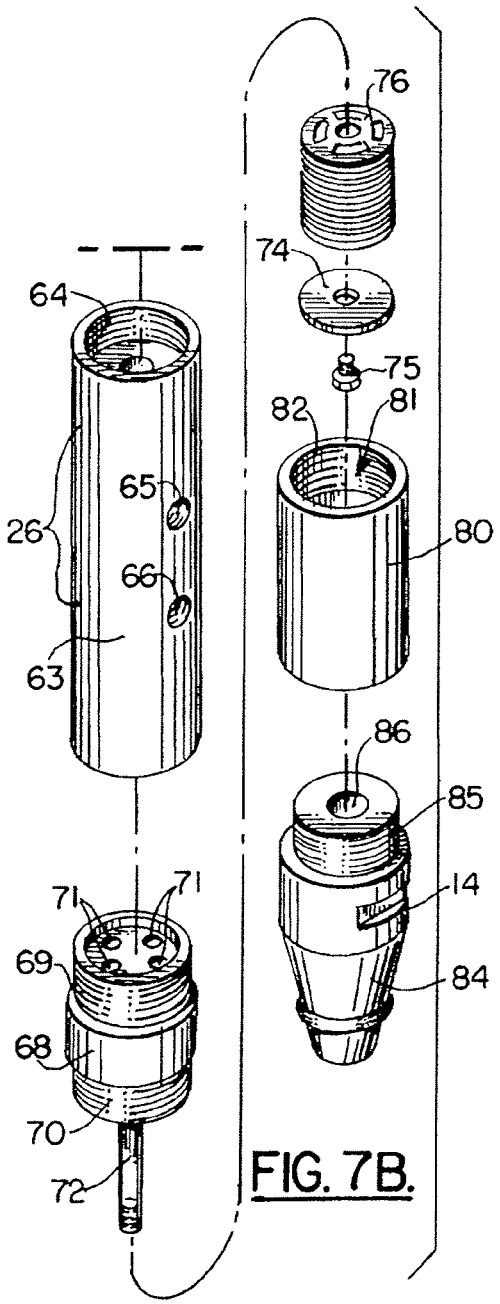
Figure 8:
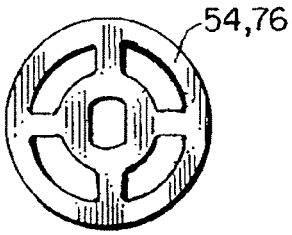
FIG. 8 is a fragmentary, top view of the preferred embodiment of the apparatus of the present invention illustrating one of the filtered disks.
Figure 9:
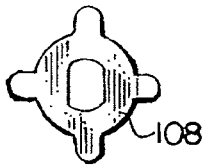
FIG. 9 is a fragmentary plan view of the preferred embodiment of the apparatus of the present invention illustrating a filter disk spacer.

Oil that flows from the producing formation in to the tool body (see arrows 27) flows upwardly via bore 86 of seating nipple 14. The lower end portion 17 of tool body 15 has a tapered section 84 that is shaped to fit seating nipple 14 as seen in FIG. 1C. An o-ring 87 on lower end 17 of tool body 15 forms a fluid seal between tool body 15 and seating nipple 14. Above passageway 86, oil is filtered with lower filter 31. Of similar construction to filter 30, filter 31 can be of alternating disks 76 and spacers 108 (FIGS. 8-9). Filter disk 76 are secured to connector 68 with shaft 72 having threaded connection 73 attaching to connector 68 while retainer plate 74 and bolt 75 hold filter disks 76 to shaft 72 (see FIG. 1B, 7B and 8-9). Connector 68 attaches to pump mechanism body 3 at threaded connection 78. Connector 68 attaches to sleeve 80 and its internal threads 82 at threaded connection 79. Sleeve 80 has bore 81 occupied by lower filter 31 (see FIGS. 1B and 7B). Seating nipple 14 attaches to the lower end of sleeve 80 with threaded connection 83. Seating nipple 14 has bore 86 and external threads 85 that connect to sleeve 80 at threaded connection 83.

Check valve 88 and its spring 89 prevent the working fluid from flowing into the formation that contains oil. The oil producing formation is below packer 13 and check valve 88. The producing oil enters the production tubing bore 18 via perforations (not shown) as is known in the art for oil wells. The check valve 88 is overcome by the pump 26 pressure as oil is pumped upwardly in the direction of arrows 27. The pump 26 includes two central impellers or rotors 94, 95. The upper central rotor 94 and outer rotor 98 are driven by the working fluid. The lower central rotor 95 and outer rotor 99 are connected to the upper rotor 94 with shaft 91 so that the lower central rotor 95 rotates when the upper rotor 95 is driven by the working fluid. Thus, driving the upper rotor 94 with the working fluid simultaneously drives the lower rotor 95 so that it pumps oil from the well production bore 18. The oil that is pumped mixes with the working fluid at perforations 114 in the production tubing as indicated schematically by the arrows 28, 29 in FIGS. 1A, 1B. The arrows 29 indicate the return of the oil/water mix in the annulus 19 that is in between casing 11 and production tubing 12.

In FIG. 11A, the oil, water (or other working fluid) mix is collected in flowline 126 and flows into oil/water separator 125 as indicated by arrows 127. Oil is then removed from the separator in flowline 128 as indicated by arrows 129 in FIG. 11A. The working fluid (e.g., water) is separated and flows via flowline 124 back into reservoir 123 for reuse as the working fluid.

As an alternate means to lower the tool body 15 into the well (if not using pumping of FIG. 11A), a neck section 32 is provided having an annular shoulder 33. This is common type of connector that is known in the oil field for lowering down hole tools into a well bore or as an alternate means of retrieval.

An upper filter 30 is provided for filtering the working fluid before it enters the pump mechanism 26. A lower filter 31 is provided for filtering oil before it enters the pump mechanism 26.

The tool body 15 includes a sleeve 35 that can be attached with a threaded connection 38 to the lower end portion of neck section 32 as shown in FIG. 1A. A pair of swab cups 37, 40 are attached to sleeve section 35 at spacer sleeve 42. The swab cup 37 provides an annular socket 39. The swab cup 40 provides an annular socket 41. The spacer sleeve 42 has a bore 43 that has an internal diameter that closely conforms to the outer surface of sleeve 35. The sleeve 35 provides bore 36 through which working fluid can flow as shown in FIGS. 1A and 1B. A third swab cup 44 is positioned just above valve housing 48 as shown in FIG. 1B. The swab cup 44 has an annular socket 47. A spacer sleeve 45 with bore 46 is sized to closely fit over sleeve 35 as shown in FIG. 1B.

Figure 7A:
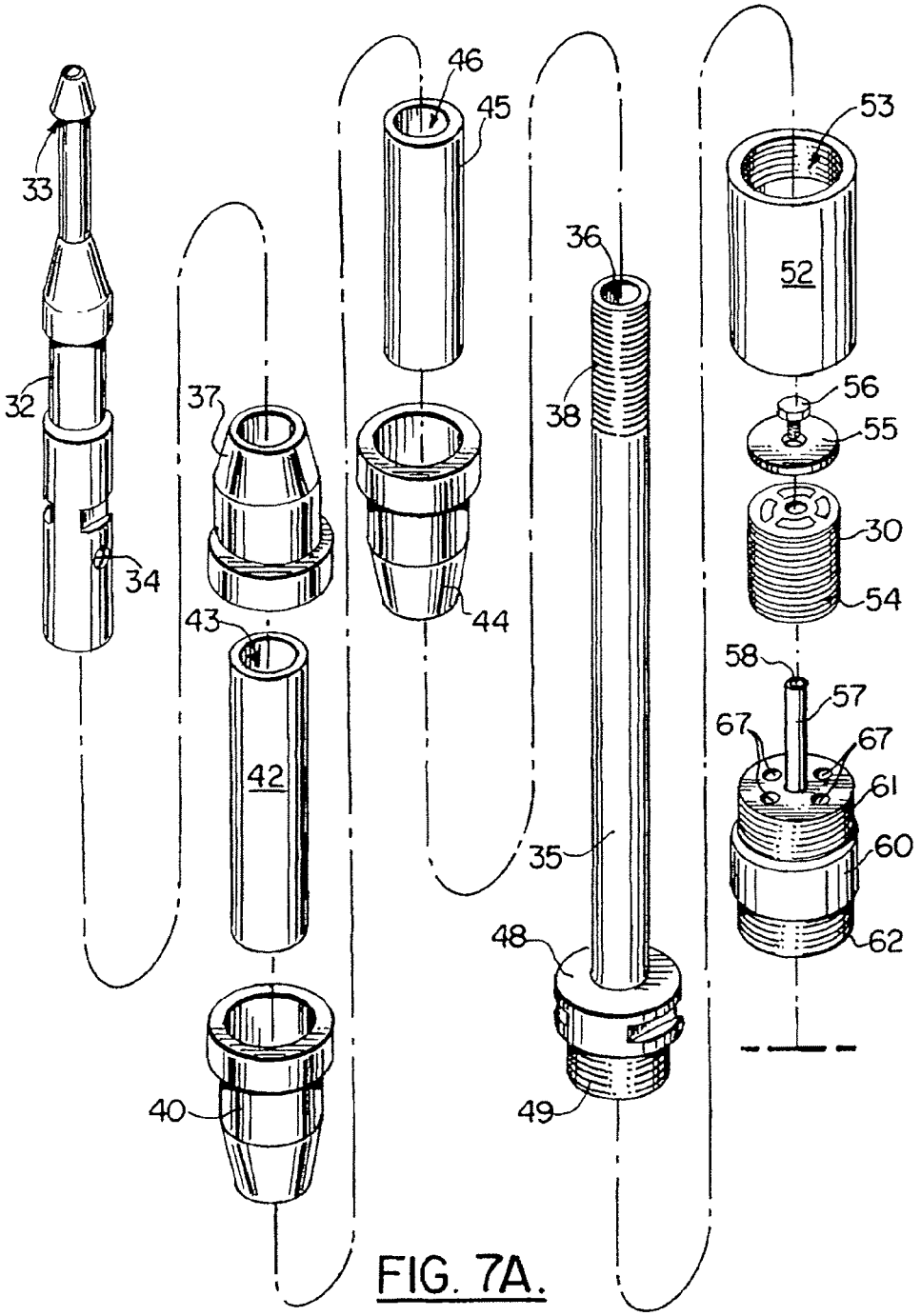
FIGS. 7A-7B are perspective views of the preferred embodiment of the apparatus of the present invention wherein the match line AA of FIG. 7A matches the match line AA of 7B.

Valve housing 48 has external threads that enable a threaded connection 49 to be formed with sleeve 52 at its bore 53 that is provided with internally threaded portions. The bore 53 of sleeve 52 carries filter 30 which is preferably in the form of a plurality of filter disks 54 separated by spacers 108 (see FIGS. 1B, 8-9). As shown in 7A, the filtered disks 54 of filter 30 are held in position upon shaft 57 with retainer plate 55 and bolt 56. Shaft 57 has an internally threaded portion 58 for receiving bolt 56 as shown in FIGS. 1B and 7A. A threaded connection 59 is formed between the lower end portion of shaft 57 and connector 60. The connector 60 has externally threaded portion 61, 62 and a plurality of longitudinally extending flow passages 71 as shown in FIG. 1B and 7A.

The pump mechanism 26 (see FIGS. 1B, 2, 3) includes a pump housing 63 that is attached using a threaded connection to the bottom of connector 60 at thread 62. The pump housing 63 in FIG. 7B has internal threads 64 that enable connection with connector 60.

Figure 2:
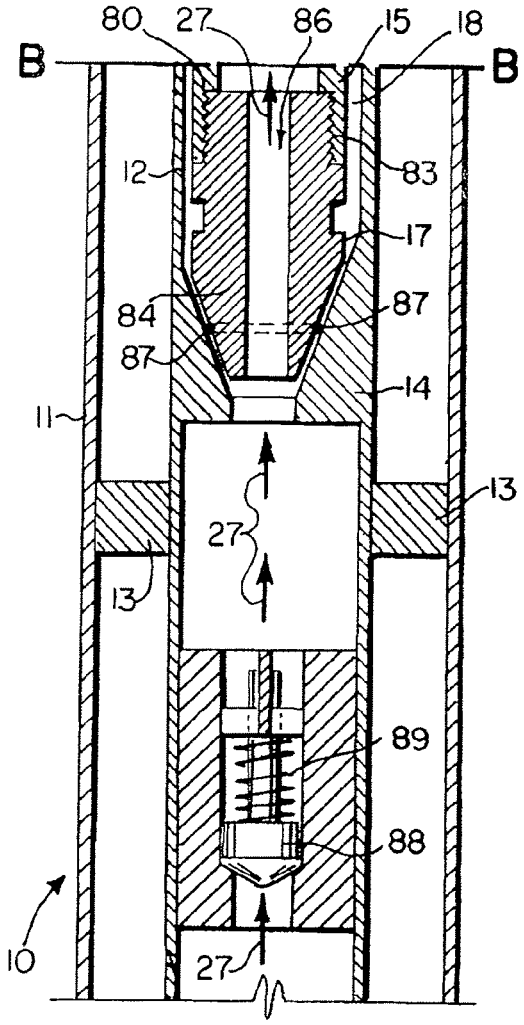
FIG. 2 is a partial exploded perspective body of the preferred embodiment of the apparatus of the present invention showing some of the pumping components.
Figure 2:
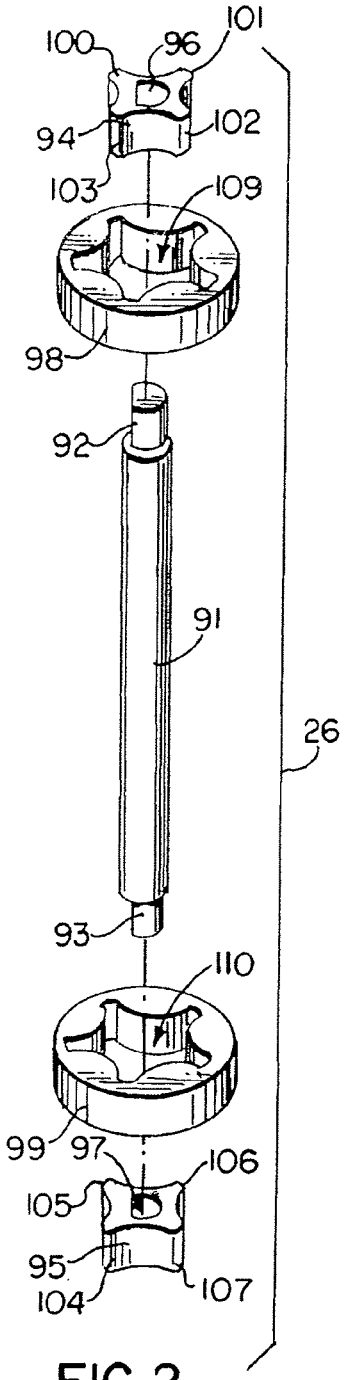
Figure 3:
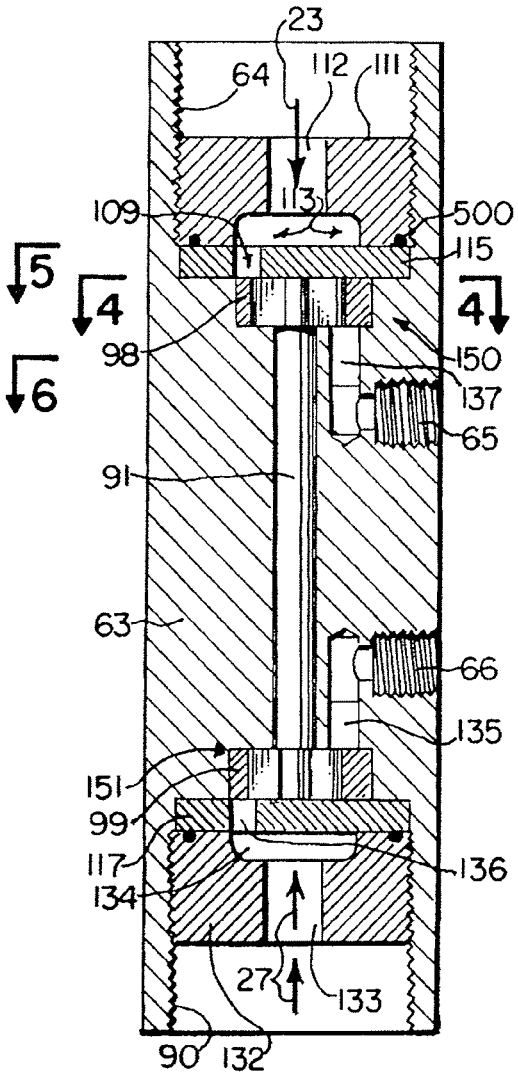
FIG. 3 is an enlarged fragmentary sectional view of the preferred embodiment of the apparatus of the present invention illustrating the pumping components.
Figure 4:
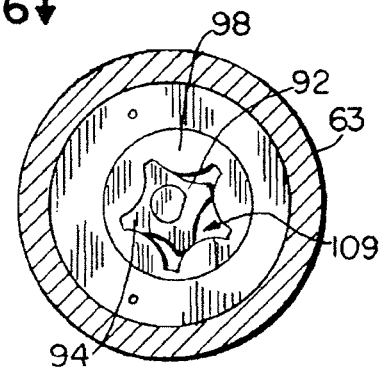
FIG. 4 is a sectional view taken along lines 4-4 of FIG. 3.
Figure 5:
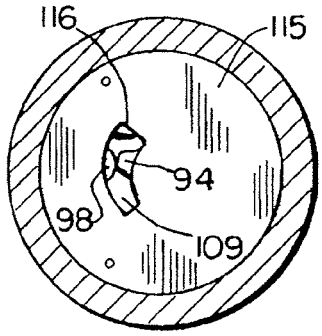
FIG. 5 is a sectional view taken along lines 5-5 of FIG. 3.
Figure 6:
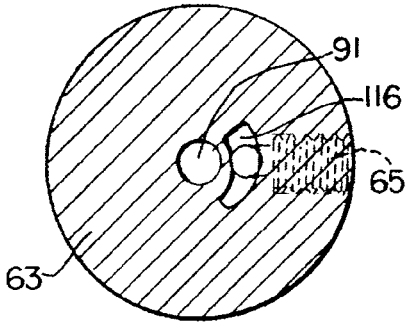
FIG. 6 is a section view taken along lines 6-6 of FIG. 3.

The housing 63 has a working fluid discharge port 65 and an oil discharge port 66 (see FIG. 3). Pump housing 63 carries shaft 91. The shaft 91 (see FIGS. 2 and 3) has keyed end portions 92, 93. Each rotor 94, 95 is provided with a correspondingly shaped opening so that it fits tightly to a keyed end portion 92 or 93 of shaft 91. In FIG. 2, the upper rotor 94 has a shaped opening 96 that fits the keyed end portion 92 of shaft 91. The rotor 95 has a shaped opening 97 that fits the keyed end portion 93 of shaft 91.

Each of the central rotors 94, 95 fits an outer rotor that has a star shaped chamber. In FIGS. 2 and 3, upper rotor 94 fits the star shaped chamber 109 of rotor 98. Similarly, the lower rotor 95 fits the star shaped chamber 110 of rotor 99.

Each rotor 94, 95 has multiple lobes (e.g., four as shown). The upper rotor 94 has lobes or gear teeth 100, 101, 102, 103. The lower rotor 95 has floor or gear teeth lobes 104, 105, 106, 107. This configuration of a star shaped inner or central rotor rotating in a star shaped chamber of an outer rotor having one more lobe than the central or inner rotor is a per se known pumping device known as a "gerotor". Gerotor pumps are disclosed, for example, in U.S. Pat. Nos. 3,273,501; 4,193,746, 4,540,347; 4,986,739; and 6,113,360 each hereby incorporated herein by reference.

Figure 10A:
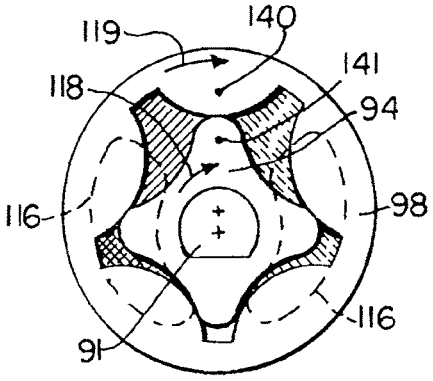
FIGS. 10A-10E are sequential illustrations that show various positions of the gerotor devices for both the upper and lower gerotors.
Figure 10B:
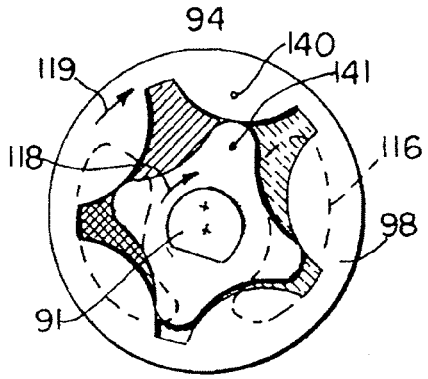
Figure 10C:
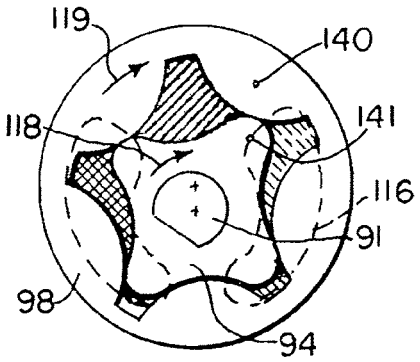
Figure 10D:
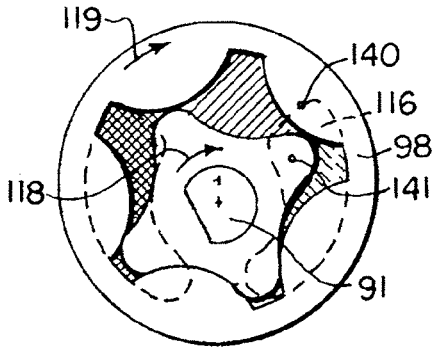
Figure 10E:
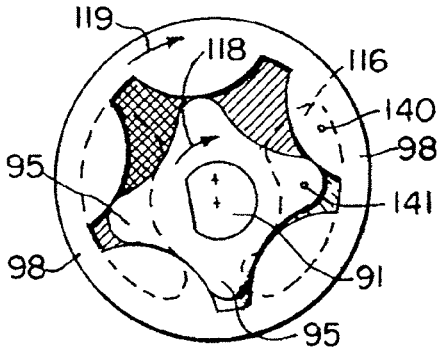

Working fluid that flows downwardly in the direction of arrow 23 enters the enlarged chamber 113 part of passageway 112 of retainer 111 so that the working fluid can enter any part of the star shaped chamber 109 of upper disk 98. An influent plate 115 is supported above upper disk 98 and provides a shaped opening 116. When the working fluid is pumped from enlarged section 113 into the star shaped chamber 109 that is occupied by upper rotor 94, both rotors 94 and 98 rotate as shown in FIGS. 10A-10E to provide an upper gerotor device 150. FIGS. 10A-10E show a sequence of operation during pumping of the upper central rotor 94 in relation to upper outer rotor 98 and its star shaped chamber 109. In FIG. 10A, the opening 116 is shown in position relative to rotors 94 and 98. The two reference dots 140, 141 are aligned in the starting position of FIG. 10A. Arrow 118 indicates the direction of rotation of rotor 94. Arrow 119 indicates the direct of rotation of upper disk 98. By inspecting the position of the reference dots 140, 141 in each of the views 10A-10E, the pumping sequence can be observed.

The two gerotor devices 150, 151 provided at the keyed end portions 92, 93 of shaft 91 each utilize an inner and outer rotors. At shaft upper end 92, upper inner rotor 94 is mounted in star shaped chamber 109 of peripheral rotor 98. As the inner, central rotor 94 rotates, the outer rotor 98 also rotates, both being driven by the working fluid that is pumped under pressure to this upper gerotor 150.

The rotor or impeller 94 rotates shaft 92 and lower inner rotor or impeller 95. As rotor 95 rotates with shaft 92, outer peripheral rotor 99 also rotates, pulling oil upwardly in the direction of arrows 27. Each inner, central rotor 94, 95 has one less tooth or lobe than its associated outer rotor 98, 99 respectively as shown in FIGS. 2 and 10A-10E. While FIGS. 10A-10E show upper rotors 94, 98, the same configuration of FIGS. 10A-10E applies for lower rotors 95, 99. An eccentric relationship is established by the parallel but nonconcentric axes of rotation of rotors 94, 98 so that full tooth or lobe engagement between rotors 94, 98 occurs at a single point only (see FIGS. 10A-10E). A s working fluid flows through passageways 112, 113 into star shaped chamber 109 and shaped opening 116, rotors 94, 98 rotate as do rotors 95, 99. Oil to be produced is drawn through suction ports 133, 134 of retainer 132 to shaped opening 136 of effluent plate 117 and then into star shaped chamber 110 of outer rotor 99. The rotating rotors 95, 99 transmit the oil to be pumped via passageway 135 to oil discharge port 66.

At discharge port 66, oil to be produced mixes with the working fluid and exits perforations 114 in production tub 12 as indicated by arrows 28 in FIG. 1B.

In the pumping mode of FIG. 11A, working fluid (e.g., water) moves from the reservoir 123 to the prime mover 121. The prime mover 121 can be a positive displacement pump that pumps the working fluid through three way valve 130. In the pumping mode, three way valve 130 handle 131 is in the down position as shown in FIG. 11A, allowing the working fluid or power fluid into the tubing 12. The working fluid pumps the tool body 15 into the seating nipple 14 and then the lower swab cups 40, 44 flare outwardly sealing against the tubing 12 causing the power fluid to then enter the ports or channel 34 at the upper end 16 of the tool body 15. The working fluid travels through the center of the stacked disk upper filter 30 into the uppermost gerotor motor 150 causing the upper gerotor 150 to rotate and, in turn, causing the shaft 92 to rotate which causes the lower gerotor 151 to turn.

When the lower gerotor 151 turns, it pumps produced oil into the casing annulus 19 so that it commingles (arrows 28) with the working fluid and returns to the surface. At the surface or wellhead 120, the oil/water separator 125 separates produced oil into a selected storage tank and recirculates the power fluid into the reservoir to complete the cycle.

Figure 11B:
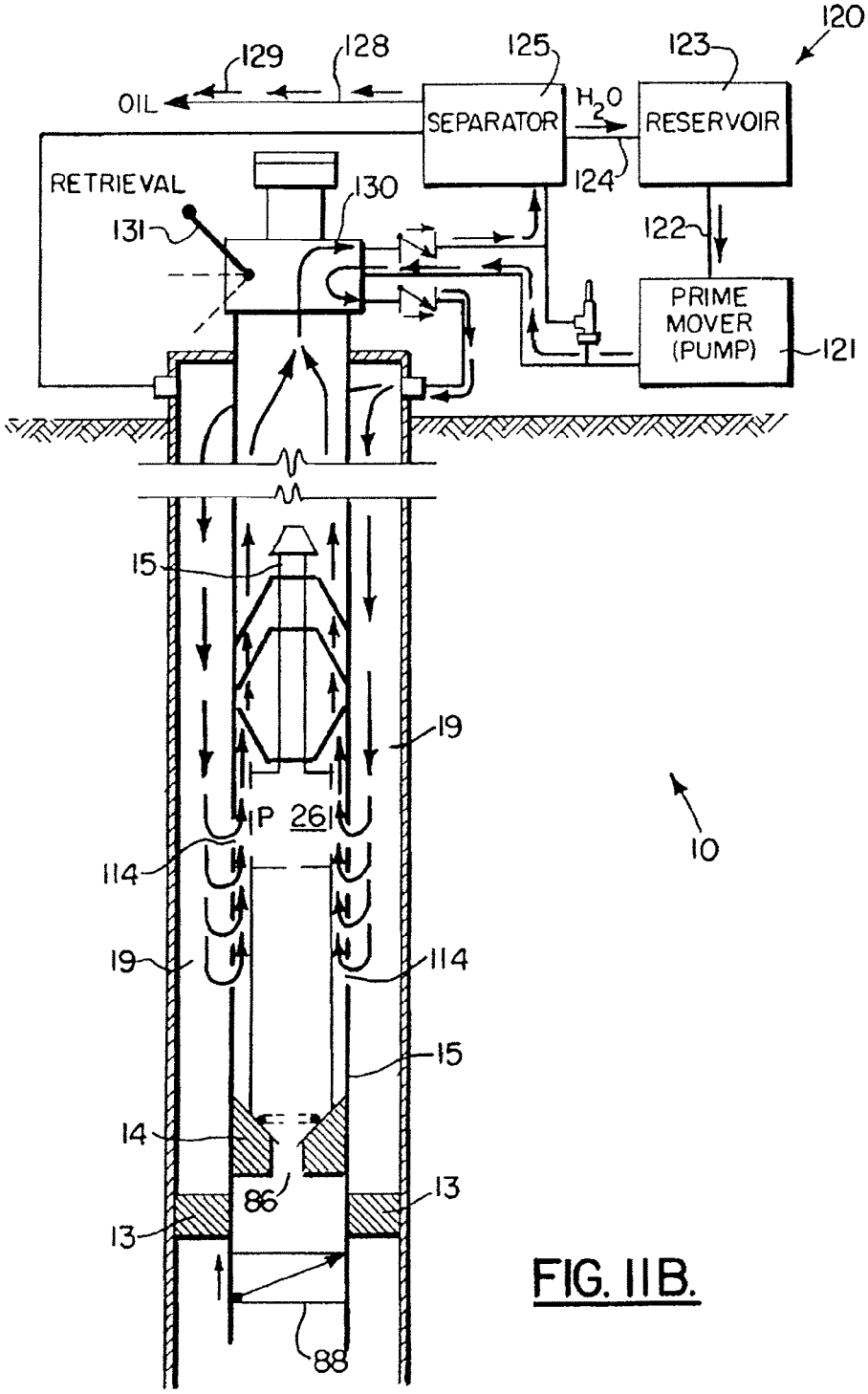
FIG. 11B is a schematic diagram showing operation of the apparatus and method of the present invention in a retrieval position.

In the retrieval mode of FIG. 11B, working fluid moves from the reservoir 123 to the prime mover 121. The positive displacement prime mover 121 pumps the working fluid through the three way valve 130. In the retrieval mode, the three way valve handle 131 is in an upper position (as shown in FIG. 11B) that allows the working fluid to enter the casing annulus 19. The working fluid enters the perforated production tubing 12 at perforations 114 but does not pass the packer 13. This working fluid that travels in the annulus 19 flares the upper swab cup 37 against the production tubing 12 causing a seal. The tool body 15 provides a check valve 88 to prevent circulation of the working fluid through the tool body 15 to the oil producing formation that is below valve 88 and packer 13. This arrangement causes the tool body 15 to lift upward and return to the wellhead 120 where it can be removed using an overshot. In FIG. 11B, the tool body 15 can thus be pumped to the surface or wellhead area 120 for servicing or replacement. The power fluid or working fluid circulates through the three way valve 130 to the oil separator 125 and then to the reservoir 123 completing the cycle.

Figure 11C:
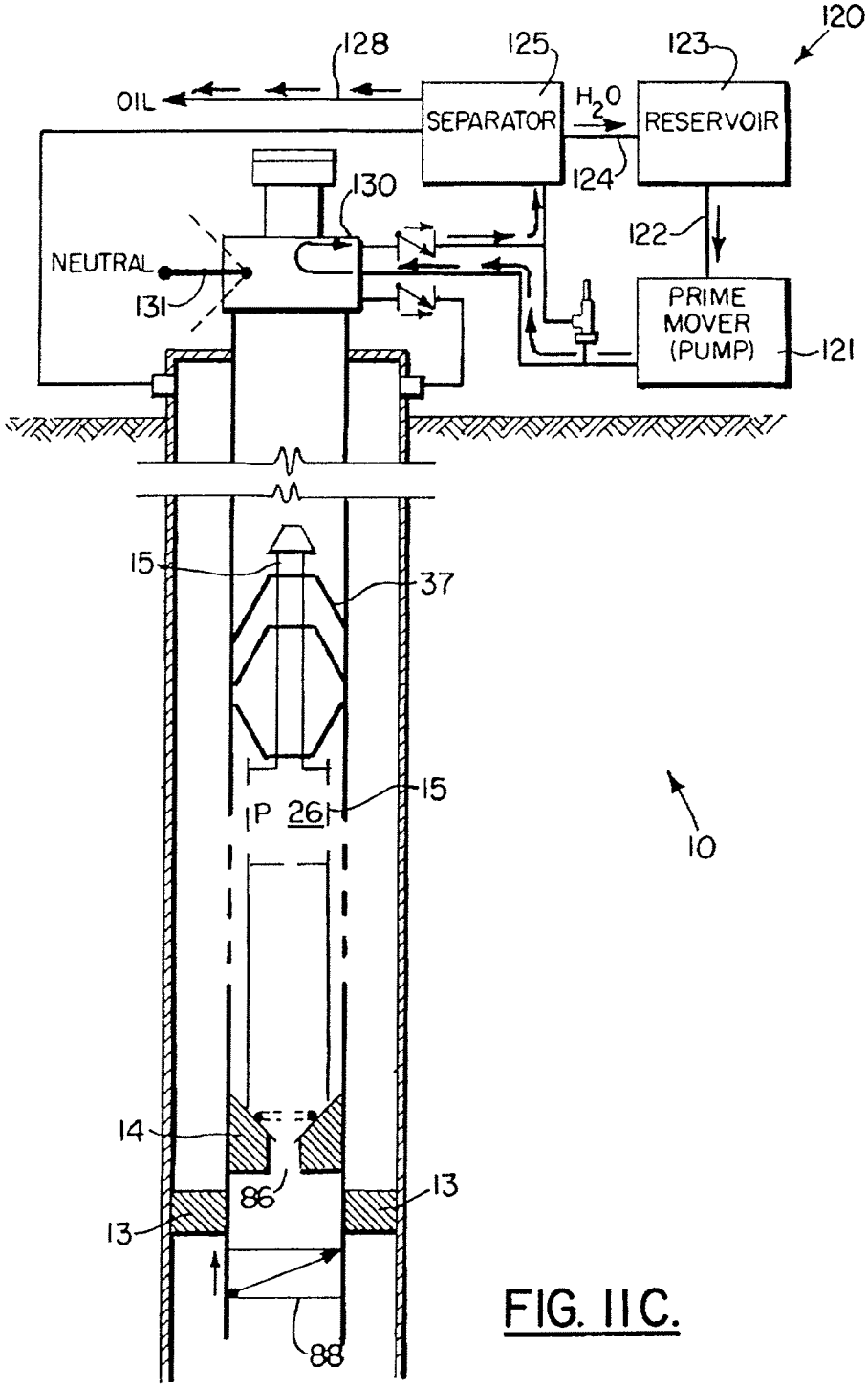
FIG. 11C is a schematic diagram showing operation of the apparatus and method of the present invention in a neutral position.
Figure 12:
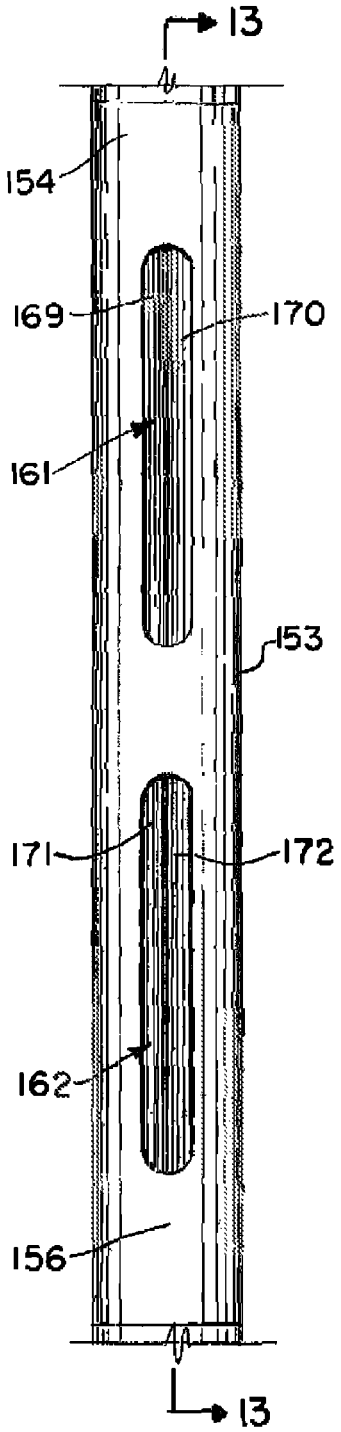
FIG. 12 is a partial elevation view of the preferred embodiment of the apparatus of the present invention, showing an alternate pumping mechanism.
Figure 13:
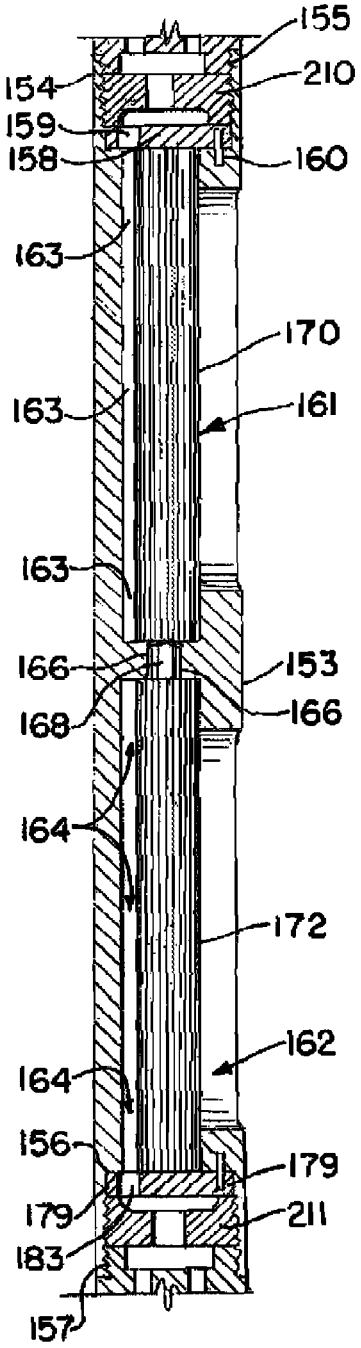
FIG. 13 is a sectional view taken along lines 13-13 of FIG. 12.
Figure 14:
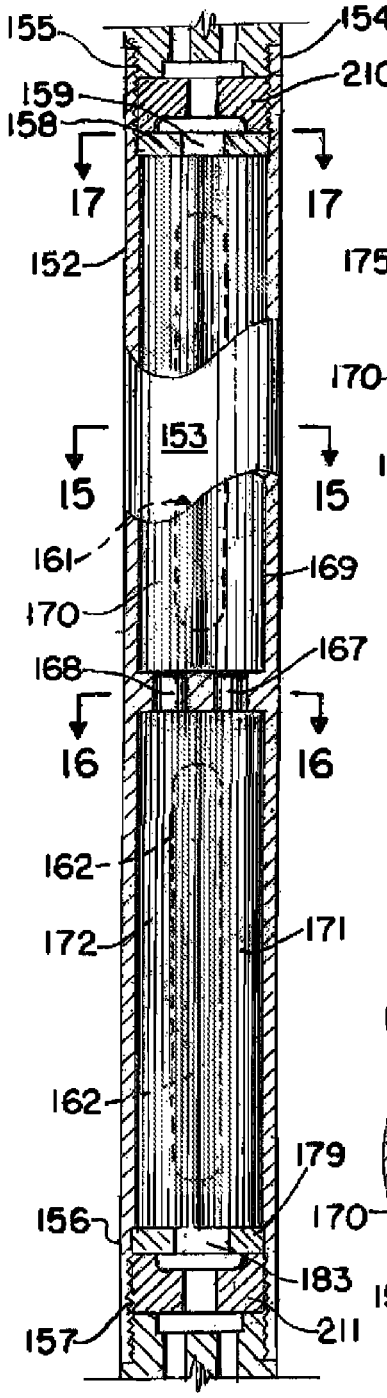
FIG. 14 is a partial elevation view of the preferred embodiment of the apparatus of the present invention, showing an alternate pumping mechanism.

In FIG. 11C, a neutral mode is shown. When the tool body 15 is captured with an overshot, for example, the three way valve 130 is placed in a middle or neutral position as shown in FIG. 11C. The FIG. 11C configuration causes the power fluid or working fluid to circulate through the three way valve 130 and directly to the separator 125 and then back to the reservoir 123. The configuration of FIG. 11A produces zero pressure on the tubing 12. A hammer union can be loosened to remove the tool body 15 and release the overshot. The tool body 15 can be removed for servicing or replacement. A replacement pump can then be placed in the tubing 12 bore 18. A well operator then replaces the hammer union and places the handle 131 of the three way valve 130 in the down position of FIG. 11A. The tool body 15 is then pumped to the seating nipple 14 as shown in FIG. 11A, seating in the seating nipple 14 so that oil production can commence.

FIGS. 12-19 show an alternate pump mechanism 152 that can be used instead of or in place of the pump mechanism 26 shown in FIGS. 1-11. As with the pump mechanism 26 having pump mechanism housing 63, the pump mechanism 152 provides a pump mechanism housing 153. In FIGS. 1-11, pump mechanism 152 and its housing 153 could replace pump mechanism 26 and its housing 63. The housings 63 and 152 could thus be similarly or interchangeably sized and shaped. Housing 153 provides an upper end portion 154 having internal threads 155 that enable a connection to be made with external threads 62 of connector 60. Housing 153 provides a lower end portion 156 having internal threads 157 that enable a connection to be made with external threads 69 of connector 68.

Pump mechanism 152 provides a plurality of spur gears 169-172. These spur gears include an upper pair of spur gears 169, 170 and a lower pair of spur gears 171, 172. Upper retainer plate 158 is positioned above gears 169, 170, held in place with a nut 210. Lower retainer plate 179 is positioned below gears 171, 172 and held in place with nut 211. Gears 169, 17 are held within upper cavity 163. Gears 171-172 are held within lower cavity 164. The pair of upper spur gears 169, 170 are contained within upper cavity 163 of pump mechanism housing 153. The lower spur gears 171, 172 are contained in the lower cavity 164 of pump mechanism housing 153.

Locking pins 160, 182 prevent disassembly of either of the retainer plates 158, 179 from pump mechanism housing 153. Longitudinally extending slots or slotted openings 161, 162 are provided in housing 153 as shown in FIGS. 12-14, 15 and 18. Shaft openings 165, 166 are provided in housing 153 and communicating in between upper cavity 163 and lower cavity 164. The shaft openings 165, 166 enable shafts 167, 168 to extend between each upper spur gear 169, 170 and a lower spur gear 171, 172. In FIGS. 14-17, upper spur gear 169 is connected to lower spur gear 171 with shaft 167. Similarly, upper spur gear 170 is connected to lower spur gear 172 with shaft 168. The upper spur gear 169 rotates with lower spur gear 171. Similarly, the gears 170, 172 rotate together. Each locking pin 160, 182 can rotate a short distance in a provided pin slot 173 which acts as a guide to align pins 160, 182 with a pin hole in plate 158 or 179. A retainer nut 111 (see FIG. 3) can be used to secure each plate 158, 179 to tool housing 153.

Each shaft 167, 168 has a generally cylindrically shaped section 174 and a D-shaped section 175. The cylindrically shaped section 174 of each shaft 167, 168 is connected to a lower spur gear 171, 172 as shown in FIG. 19. The D-shaped section 175 of each shaft 167, 168 connects to a D-shaped bore 176 that is provided on each of the upper spur gears 169, 170. Each of the spur gears 169-172 has longitudinally extending and radially extending, circumferentially spaced apart teeth 177 as shown in FIGS. 15-19. Each gear 171-172 is contained within a partial cylindrically shaped section 180, 181 of cavity 163, 164.

Each of the upper and lower cavities 163, 164 provides a rear section 178 that communicates with influent opening/channel 159.

Figure 15:
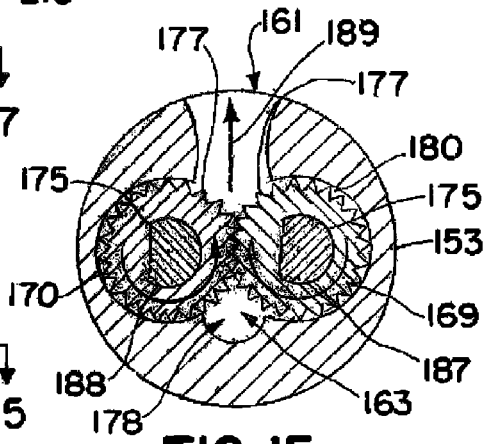
FIG. 15 is a sectional view taken along lines 15-15 of FIG. 14.
Figure 16:
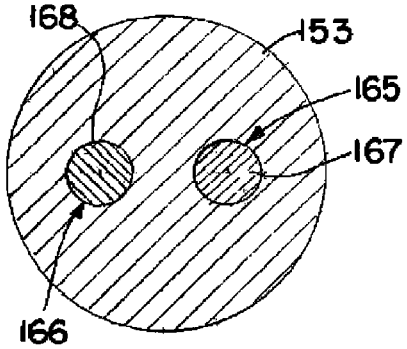
FIG. 16 is a sectional view taken along lines 16-16 of FIG. 14.
Figure 17:
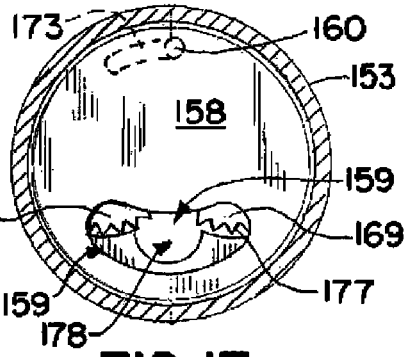
FIG. 17 is a sectional view taken along lines 16-16 of FIG. 14.
Figure 18:
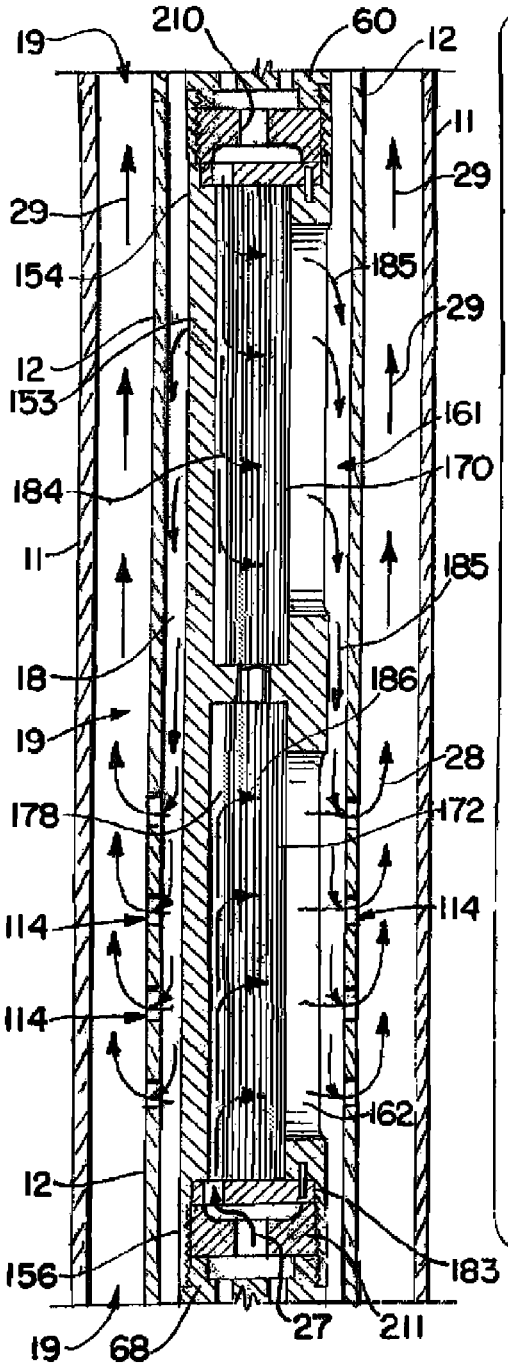
FIG. 18 is a partial sectional view of the preferred embodiment of the apparatus of the present invention showing the alternate pumping mechanism.
Figure 19:
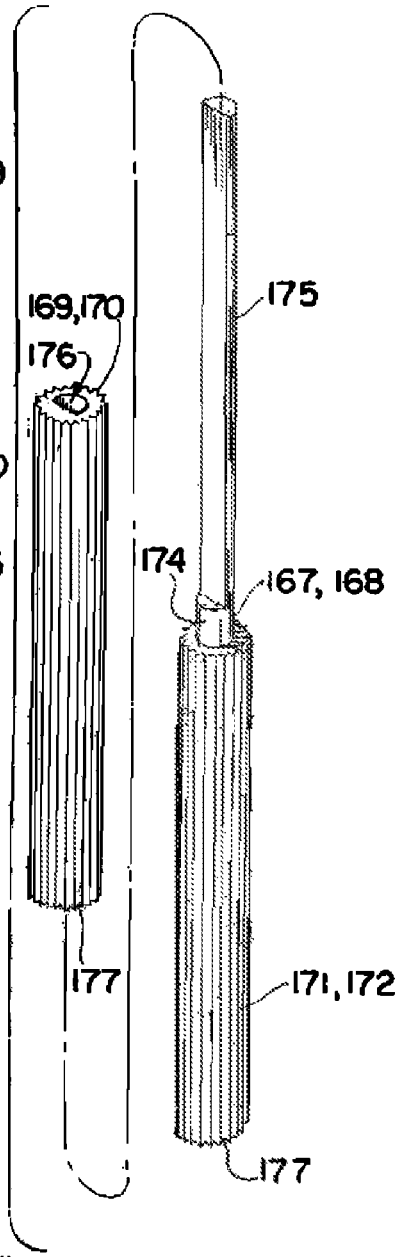
FIG. 19 is a partial sectional view of the preferred embodiment of the apparatus of the present invention showing the alternate pumping mechanism.

Influent working fluid travels from influent opening/influent channel 159 downwardly in the direction of arrows 23, 184 in FIG. 18. This influent fluid that follows arrows 23, 184 is a working fluid, the same working fluid described with respect to FIGS. 1-11. The working fluid that travels in the direction of arrows 23, 184 from rear section 178 of upper cavity 163 and through upper spur gears 169, 170 as indicated by arrow 189 in FIG. 15. This fluid flow rotates the gear 169 in the direction of arrow 187 and the gear 170 in the direction of arrow 188 as shown in FIG. 15. This rotation of the upper gears 169, 170 also rotates the lower gears 171, 172.

Oil to be pumped travels in the direction of arrows 27, 186 into oil inlet opening 183 and into the rear section 178 of lower cavity 174 and through the gears 171, 172. The flowing working fluid which follows the direction of arrows 23, 184 in FIG. 18 exits the upper cavity 163 via upper slot 161 as indicated by arrows 185. The oil being pumped travels in the direction of arrows 127, 186 and exits lower slot 162, mixing with the working fluid. The working fluid and oil pass through perforations 114 as indicated in FIG. 18 by the arrows 28, returning to the surface area via annulus 19.

Figure 20:
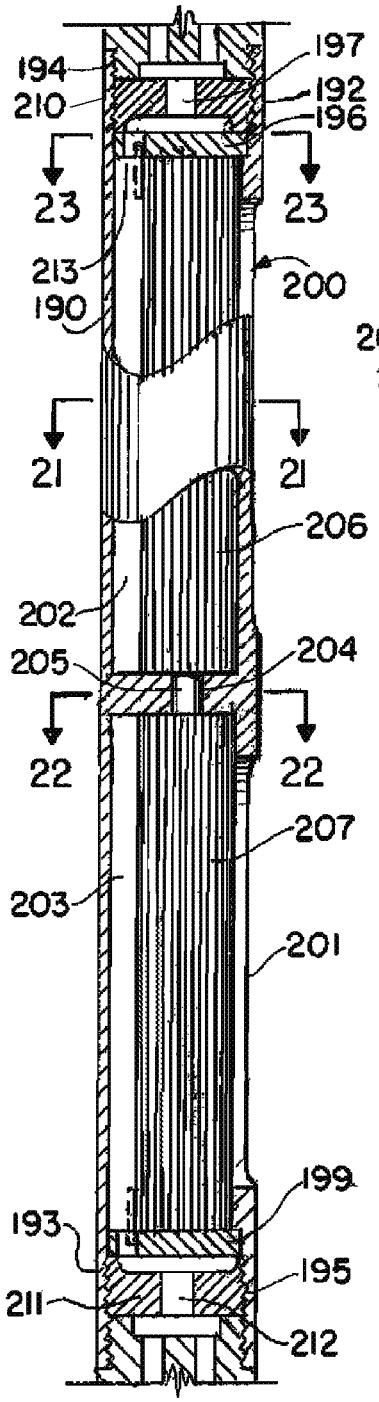
FIG. 20 is a sectional view of a second embodiment of the apparatus of the present invention.
Figure 21:
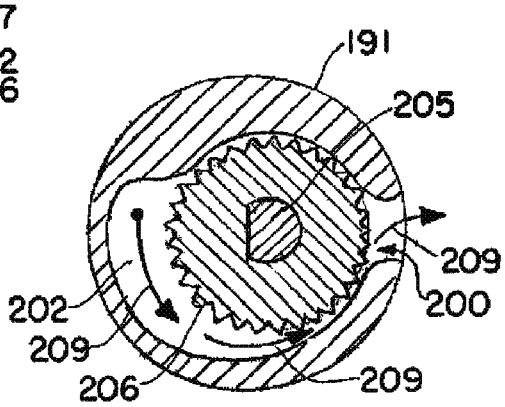
FIG. 21 is a sectional view taken along lines 21-21 of FIG. 20.
Figure 22:
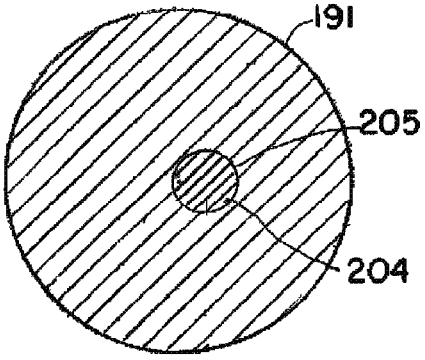
FIG. 22 is a sectional view taken along lines 22-22 of FIGS. 20.
Figure 23:
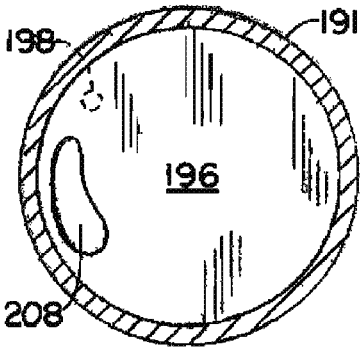
FIG. 23 is a sectional view taken along lines 23-23 of FIG. 20.

FIGS. 20-23 show an alternate embodiment of the apparatus of the present invention wherein the pump mechanism 190 includes a single upper spur gear 206 and a single lower spur gear 207. Pump mechanism 190 provides a pump mechanism housing 191 having an upper end portion 192 and a lower end portion 193. As with the preferred embodiment, the pump mechanism housing 191 provides upper internal threads 194 and lower internal threads 195. An upper retainer plate 196 is positioned above upper spur gear 206. Upper retainer plate 196 provides an influent opening/channel 197. Lower retaining plate 199 is positioned under lower spur gear 207. Such upper and lower retainer plates 196, 199 can be held in position using locking nuts 210, 211 respectively as shown in FIG. 20. The locking nut 210 provides channel 197. The locking nut 211 provides flow channel 212. As with the preferred embodiment, a working fluid is pumped down a hole via a work string to influent opening/channel 197 and then into upper cavity 202 via port 208. The fluid then flows in the direction of arrows 209 from upper cavity 202 to the exterior of housing 191 via upper slot 200. As with the preferred embodiment, the rotation of the spur gear 206 rotates shaft 205 which also rotates the lower spur gear 207. As with the preferred embodiment, the shaft 205 passes through a shaft opening 205 that is in between the upper cavity 202 and the lower cavity 203.

The following is a list of suitable parts and materials for the various elements of the preferred embodiment of the present invention.

PARTS LIST

| Part Number | Description |
|---|---|
| 10 | oil well pump |
| 11 | casing |
| 12 | production tubing |
| 13 | packer |
| 14 | seating nipple |
| 15 | tool body |
| 16 | upper end portion |
| 17 | lower end portion |
| 18 | bore |
| 19 | annulus |
| 20 | arrow |
| 21 | arrow |
| 22 | arrow |
| 23 | arrow |
| 24 | arrow |
| 25 | check valve |
| 26 | pump mechanism |
| 27 | oil flow arrow |
| 28 | oil mix flow arrow |
| 29 | return flow arrow |
| 30 | filter, upper |
| 31 | filter, lower |

-continued

PARTS LIST

| Part Number | Description |
|---|---|
| 32 | neck section |
| 33 | annular shoulder |
| 34 | channel |
| 35 | sleeve |
| 36 | sleeve bore |
| 37 | swab cup |
| 38 | threaded connection |
| 39 | annular socket |
| 40 | swab cup |
| 41 | annular socket |
| 42 | spacer sleeve |
| 43 | bore |
| 44 | swab cup |
| 45 | spacer sleeve |
| 46 | bore |
| 47 | annular socket |
| 48 | valve housing |
| 49 | threaded connection |
| 50 | spring |
| 51 | passageway |
| 52 | sleeve |
| 53 | bore |
| 54 | filter disk |
| 55 | retainer plate |
| 56 | bolt |
| 57 | shaft |
| 58 | internal threads |
| 59 | threaded connection |
| 60 | connector |
| 61 | external threads |
| 62 | external threads |
| 63 | pump mechanism housing |
| 64 | internal threads |
| 65 | working fluid discharge port |
| 66 | produced oil discharge port |
| 67 | flow passage |
| 68 | connector |
| 69 | external threads |
| 70 | external threads |
| 71 | flow passage |
| 72 | shaft |
| 73 | threaded connection |
| 74 | retainer plate |
| 75 | bolt |
| 76 | filler disk |
| 78 | threaded connection |
| 79 | threaded connection |
| 80 | sleeve |
| 81 | bore |
| 82 | internal threads |
| 83 | threaded connection |
| 84 | tapered section |
| 85 | external threads |
| 86 | bore |
| 87 | o-ring |
| 88 | check valve |
| 89 | spring |
| 90 | internal threads |
| 91 | shaft |
| 92 | keyed portion |
| 93 | keyed portion |
| 94 | upper rotor |
| 95 | lower rotor |
| 96 | shaped opening |
| 97 | shaped opening |
| 98 | outer rotor |
| 99 | outer rotor |
| 100 | lobe |
| 101 | lobe |
| 102 | lobe |
| 103 | lobe |
| 104 | lobe |
| 105 | lobe |
| 106 | lobe |
| 107 | lobe |

-continued

PARTS LIST

| Part Number | Description |
|---|---|
| 108 | spacer |
| 109 | star shaped chamber |
| 110 | star shaped chamber |
| 111 | retainer |
| 112 | passageway |
| 113 | enlarged section |
| 114 | perforations |
| 115 | influent plate |
| 116 | shaped opening |
| 117 | effluent plate |
| 118 | arrow |
| 119 | arrow |
| 120 | wellhead area |
| 121 | prime mover |
| 122 | flowline |
| 123 | reservoir |
| 124 | flowline |
| 125 | separator |
| 126 | flowline |
| 127 | arrow |
| 128 | flowline |
| 129 | arrow |
| 130 | three way valve |
| 131 | handle |
| 132 | retainer |
| 133 | suction port |
| 134 | suction port |
| 135 | passageway |
| 136 | shaped opening |
| 137 | passageway |
| 140 | reference dot |
| 141 | reference dot |
| 150 | upper gerotor device |
| 151 | lower gerotor device |
| 152 | pump mechanism |
| 153 | pump mechanism housing |
| 154 | upper end portion |
| 155 | internal threads |
| 156 | lower end portion |
| 157 | internal threads |
| 158 | upper retainer plate |
| 159 | influent opening/channel |
| 160 | locking pin |
| 161 | upper slot |
| 162 | lower slot |
| 163 | upper cavity |
| 164 | lower cavity |
| 165 | shaft opening |
| 166 | shaft opening |
| 167 | shaft |
| 168 | shaft |
| 169 | upper spur gear |
| 170 | upper spur gear |
| 171 | lower spur gear |
| 172 | lower spur gear |
| 173 | pin slot |
| 174 | cylindrically shaped section |
| 175 | D-shaped section |
| 176 | D-shaped bore |
| 177 | longitudinally extending teeth |
| 178 | rear section |
| 179 | lower retainer plate |
| 180 | partial cylindrically shaped section |
| 181 | partial cylindrically shaped section |
| 182 | locking pin |
| 183 | oil inlet opening |
| 184 | arrow |
| 185 | arrow |
| 186 | arrow |
| 187 | arrow |
| 188 | arrow |
| 189 | arrow |
| 190 | pump mechanism |
| 191 | pump mechanism housing |
| 192 | upper end portion |

-continued

| PARTS LIST | |
|---|---|
| Part Number | Description |
| 193 | lower end portion |
| 194 | internal threads |
| 195 | internal threads |
| 196 | upper retainer plate |
| 197 | influent opening/channel |
| 198 | locking pin |
| 199 | lower retainer plate |
| 200 | upper slot |
| 201 | lower slot |
| 202 | upper cavity |
| 203 | lower cavity |
| 204 | shaft opening |
| 205 | shaft |
| 206 | upper spur gear |
| 207 | lower spur gear |
| 208 | port |
| 209 | arrow |
| 210 | locking nut |
| 211 | locking nut |
| 212 | flow channel |

The foregoing embodiments are presented by way of example only; the scope of the present invention is to be limited only by the following claims.

The invention claimed is:

1. An oil pump apparatus for pumping oil from an oil well having a wellhead and a well bore with casing and a production tubing string, comprising:

a) a tool body that is sized and shaped to be lowered into the production tubing string of an oil well, the tool body having an outer wall;

b) a transverse portion dividing the toot body into upper and lower sections, the transverse portion being a seal that prevents fluid flow from the upper section to the lower section;

c) spaced apart, longitudinally extending upper and lower openings in the tool body wall, each of said and upper and lower openings enabling flow to exit the tool body laterally;

d) a casing and a production tubing;

e) a working fluid that can be pumped into the production tubing;

f) a prime mover for pumping the working fluid;

g) a flow channel in the well bore that enables the working fluid to be circulated from the prime mover via the production tubing to the tool body at a location in the well and then back to the wellhead area;

h) a pumping mechanism on the tool body that includes a rotary shaft, the pumping mechanism including a first impeller contained within said first upper section that is driven by the working fluid and a second impeller contained within said lower section that is mounted for rotation on said shaft with and is rotated by the first impeller, the second impeller pumping oil from the well via the toot body lower longitudinally extending opening;

i) wherein the working fluid flows downwardly in the tool body and then laterally through the first impeller and upper longitudinally extending opening;

j) wherein oil flows laterally through the second impeller and exits the tool body via the lower, longitudinally extending opening;

k) wherein the tool body has flow conveying portions that mix the working fluid and the oil as the oil is pumped;

l) wherein the pumping mechanism transmits the commingled fluid of oil and working fluid to the wellhead area; and m) wherein the said shaft extends through the transverse portion and the shaft does not convey working fluid from the upper section to the lower section.

2. The oil pump apparatus of claim 1 further comprising a filter in the tool body that is positioned to filter the working fluid before it reaches the pumping mechanism.

3. The oil pump apparatus of claim 1 further comprising a filter in the tool body that is positioned to filter the oil being pumped before it reaches the pumping mechanism.

4. The oil pump apparatus of claim 1 wherein the working fluid is water or oil or a mixture of oil and water.

5. The oil pump apparatus of claim 1 wherein the working fluid is a fluid mixture of oil and water.

6. The oil pump apparatus of claim 1 wherein the working fluid is oil.

7. The oil pump apparatus of claim 1 wherein the impellers include upper and lower impellers connected by only one common shaft.

8. An oil pump apparatus for pumping oil from an oil well having a wellhead and a well bore with casing and a production tubing string, comprising:

a) a tool body that is sized and shaped to be lowered into the production tubing string of an oil well, the tool body including a transverse portion dividing the tool body into upper and lower sections, the transverse portion including a shaft opening and a seal that prevents fluid flow from the upper section to the lower section;

b) each of said upper and lower sections have a longitudinally extending opening that enables flow to exit the tool body laterally;

c) a casing and a production tubing;

d) a working fluid that can be pumped into the production tubing;

e) a prime mover for pumping the working fluid;

f) a flow channel in the well bore that enables the working fluid to be circulated from the prime mover via the production tubing to the tool body at a location in the well and then back to the wellhead area;

g) a pumping mechanism on the tool body that includes a rotary shaft, the pumping mechanism including a first impeller housed within the upper section that is driven by the working fluid and a second impeller housed within the lower section that is rotated by the first impeller, the second impeller pumping oil from the well via the tool body, wherein the first and second impellers are mounted on said shaft, wherein the shaft passes through the shaft opening of said transverse portion, the shaft not conveying working fluid from the upper section to the lower section;

h) wherein the tool body has flow conveying portions that mix the working fluid and the oil as the oil is pumped;

i) wherein the working fluid flows laterally through the first impeller exiting the tool body via the upper longitudinally extending opening;

j) wherein oil flows laterally through the second impeller and exits the tool body via the lower longitudinally extending opening; and k) wherein the tool body has flow conveying portions that mix the oil and working fluid as the oil is pumped.

9. The oil pump apparatus of claim 8 further comprising a swab cup on the tool body that enables the tool body to be pumped into the well bore via the production tubing string using the working fluid.

10. An oil pump apparatus for pumping oil from an oil well having a wellhead and a well bore with casing and a production tubing string, comprising:

a) a tool body that is sized and shaped to be lowered into the production tubing string of an oil well, the tool body including upper and lower sections separated by a transverse seal;

b) each of said upper and lower sections have a longitudinally extending opening that enables flow to pass laterally from the tool body;

c) a casing and production tubing;

d) a working fluid that can be pumped into the production tubing;

e) a prime mover for pumping the working fluid;

f) a flow channel in the well bore that enables the working fluid to be circulated from the prime mover via the production tubing to the tool body at a location in the well and then back to the wellhead area;

g) a pumping mechanism on the tool body that includes a rotary shaft, the pumping mechanism including a first impeller on the shaft that is driven by the working fluid and a second impeller on the shaft that is rotated by the first impeller, the second impeller pumping oil from the well via the tool body, said impellers rotating together upon said shaft;

h) wherein the tool body has flow conveying portions that mix the working fluid and the oil as the oil is pumped;

i) wherein the working fluid flows laterally through the first impeller exiting the tool body via the upper longitudinally extending opening;

j) wherein oil flows laterally through the second impeller and exits the tool body via the lower longitudinally extending opening;

k) wherein the pumping mechanism transmits the commingled fluid of oil and working fluid to the wellhead area; and l) wherein the shaft extends through the transverse portion and does not convey said working fluid.

11. The oil pump apparatus of claim 10 further comprising a swab cup on the tool body that enables the tool body to be pumped to the well head area using the working fluid.

12. The oil pump apparatus of claim further comprising a filter in the tool body that is positioned to filter the working fluid before it reaches the pumping mechanism.

13. The oil pump apparatus of claim 10 further comprising a fitter in the tool body that is positioned to filter the oil being pumped before it reaches the pumping mechanism.

14. The oil pump apparatus of claim 10 wherein the working fluid is water or oil or a mixture of oil and water.

15. The oil pump apparatus of claim 10 wherein the working fluid is a fluid mixture of oil and water.

16. The oil pump apparatus of claim 10 wherein the working fluid is oil.

17. The oil pump apparatus of claim 10 further comprising a swab cup on the tool body that enables the tool body to be pumped to the well bore via the production tubing using the working fluid.

18. The oil pump apparatus of claim 10 further comprising a check valve positioned on the tool body above the pumping mechanism that prevents oil flow inside the tool body above the pumping mechanism.

19. The oil pump apparatus of claim 10 further comprising a check valve positioned below the pumping mechanism that prevents the flow of the working fluid inside the tool body to a position below the tool body.

20. The oil pump apparatus of claim 10 wherein the impellers include upper and lower impellers connected by only one common shaft.

21. An oil pump apparatus for pumping oil from an oil well having a wellhead and a well bore with casing and a production tubing string, comprising:

a) a tool body that is sized and shaped to be lowered into the production tubing string of an oil well, the tool body having an outer wall;

b) a transverse sortion dividing the tool body into upper and lower sections, the transverse portion being a seal that prevents fluid flow from the upper section to the lower section;

c) spaced apart, longitudinally extending upper and lower openings in the tool body wall, each of said upper and lower openings enabling flow to exit the tool body laterally;

d) a casing and a production tubing;

e) a working fluid that can be pumped into the production tubing;

f) a prime mover for pumping the working fluid:

g) a flow channel in the well bore that enables the working fluid to be circulated from the prime mover via the production tubing to the tool body at a location in the well and then back to the wellhead area;

h) a pumping mechanism on the tool body that includes a rotar shaft the pumping mechanism including a first impeller contained within said first upper section that is driven by the working fluid and a second impeller contained within said lower section that is mounted for rotation on said shaft with and is rotated by the first impeller, the second impeller pumping oil from the well via the tool body lower longitudinally extending opening;

i) wherein the working fluid flows downwardly in the tool body and then laterally through the first imeller and upper longitudinally extending opening;

j) wherein the tool body has flow conveying portions that mix the working fluid and oil as the oil is pumped;

k) wherein the pumping mechanism transmits the commingled fluid of oil and working fluid to the wellhead area;

l) wherein the said shaft extends through the transverse portion and the shaft does not convey working fluid from the upper section to the lower section; and m) wherein the pumping mechanism includes upper and lower gerotor mechanisms, each gerotor mechanism having an inner rotor having multiple lobes that interfaces with an outer rotor having more lobes than the inner rotor.

22. An oil pump apparatus for pumping oil from an oil well having a wellhead and a well bore with casing and a production tubing string, comprising:

a) a tool body that is sized and shaped to be lowered into the production tubing string of an oil well, the body having upper and lower sections separated by a transverse wall;

b) each of said upper and lower sections having a longitudinally extending opening that enables flow to pass laterally from the tool body;

c) a casing and production tubing;

d) a working fluid that can be pumped into the production tubing;

e) a prime mover for pumping the working fluid;

f) a flow channel in the well bore that enables the working fluid to be circulated from the prime mover via the production tubing to the toot body at a location in the well and then back to the wellhead area;

g) a pumping mechanism on the tool body that includes a rotary shaft, the pumping mechanism including a first impeller on the shaft in the upper section that is driven by the working fluid and a second impeller on the shaft in the lower section that is rotated by the first impeller upon said shaft, the second impeller pumping oil from the well via the tool body;

h) wherein the working fluid flows laterally through the first impeller and exits the tool body via the upper longitudinally extending opening;

i) wherein oil flows laterally through the second impeller and exits the tool body via the lower, longitudinally extending opening;

j) wherein the tool body has flow conveying portions that mix the working fluid and the oil as the oil is pumped;

k) wherein the pumping mechanism transmits the commingled fluid of oil and working fluid to the wellhead area;

l) the transverse wall having a shaft opening that is receptive of said shaft; and m) wherein said shaft does not convey all of said working fluid.

23. The oil pump apparatus of claim 22 further comprising a filter in the tool body that is positioned to filter the working fluid before it reaches the pumping mechanism.

24. The oil pump apparatus of claim 22 further comprising a filter in the tool body that is positioned to filter the oil being pumped before it reaches the pumping mechanism.

25. The oil pump apparatus of claim 22 wherein the working fluid is water or oil or a mixture of oil and water.

26. The oil pump apparatus of claim 22 wherein the working fluid is a fluid mixture of oil and water.

27. The oil pump apparatus of claim 22 wherein the working fluid is oil.

28. The oil pump apparatus of claim 22further comprising a swab cup on the tool body that enables the tool body to be pumped to the well head area using the working fluid.

29. The oil pump apparatus of claim 22 further comprising a swab cup on the tool body that enables the toot body to be pumped into the well bore via the production tubing string using the working fluid.

30. The oil pump apparatus of claim 29 further comprising a swab cup on the tool body that enables the tool body to be pumped to the well head area using the working fluid.

31. The oil pump apparatus of claim 28 further comprising a swab cup on the tool body that enables the tool body to be pumped into the welt bore via the production tubing string using the working fluid.

32. The oil pump apparatus of claim 22 further comprising a check valve on the tool body that prevents oil flow inside the tool body above the pumping mechanism.

33. The oil pump apparatus of claim 22 further comprising a check valve on the tool body that prevents the flow of the working fluid inside the tool body to a position below the tool body.

34. The oil pump apparatus of claim 22 wherein the impellers include upper and lower impellers connected by a common shaft.

35. The oil pump apparatus of claim 22 wherein the pumping mechanism includes a gerotor mechanism.

* * * * *